United States Patent [19]

Matsubayashi et al.

[11] Patent Number: 4,887,732

[45] Date of Patent: Dec. 19, 1989

[54] EASY-OPEN LID IN WHICH SCORE CUT EDGE CAN BE COVERED AND PROCESS FOR PREPARATION THEREOF

[75] Inventors: Hiroshi Matsubayashi, Kamakura; Masanori Aizawa, Yokohama; Michio Watanabe, Yokohama; Takashi Shimizu, Yokohama; Tamotsu Ikegami, Yokohama, all of Japan

[73] Assignee: Toyo Seikan Kaisha, Ltd., Tokyo, Japan

[21] Appl. No.: 188,793

[22] PCT Filed: Jun. 12, 1987

[86] PCT No.: PCT/JP87/00382

§ 371 Date: Apr. 11, 1988

§ 102(e) Date: Apr. 11, 1988

[87] PCT Pub. No.: WO87/07581

PCT Pub. Date: Dec. 17, 1987

[30] Foreign Application Priority Data

| | | | |
|---|---|---|---|
| Jun. 13, 1986 | [JP] | Japan | 61-136309 |
| Jun. 13, 1986 | [JP] | Japan | 61-136310 |
| Jun. 13, 1986 | [JP] | Japan | 61-136311 |
| Dec. 9, 1986 | [JP] | Japan | 61-291515 |
| May 29, 1987 | [JP] | Japan | 62-131399 |

[51] Int. Cl.[4] ..... A47G 19/22; B21D 51/44; B32B 3/02

[52] U.S. Cl. ..... 220/90.6; 220/270; 413/13; 413/14; 413/18; 428/64; 428/66

[58] Field of Search ..... 220/90.6, 269, 270, 220/271, 359; 413/13, 14, 18; 428/64, 66

[56] References Cited

U.S. PATENT DOCUMENTS

| | | | |
|---|---|---|---|
| 3,754,678 | 8/1973 | Fox et al. | 220/90.6 X |
| 3,765,561 | 10/1973 | Hekal et al. | 220/90.6 X |
| 3,809,283 | 5/1974 | Kehe | 220/90.6 X |
| 3,855,026 | 12/1974 | Fox et al. | 220/90.6 X |
| 4,044,916 | 8/1977 | Beveridge | 220/90.6 X |
| 4,403,710 | 9/1983 | Hirota et al. | 220/270 |
| 4,428,494 | 1/1984 | Hirota et al. | 220/270 |
| 4,762,245 | 8/1988 | Matsubayashi et al. | 220/270 X |

*Primary Examiner*—Jimmy G. Foster
*Assistant Examiner*—Nova Stucker
*Attorney, Agent, or Firm*—Sughrue, Mion, Zinn, Macpeak & Seas

[57] ABSTRACT

The primary object of the present invention is to provide an easy-open lid having an opening score defining a portion to be opened, an opening tab formed on the portion to be opened and a covering strip of a protecting resin formed to stride over the opening score beyond both the sides of the score, which is excellent in the rusting-preventing property of the score portion and the stain resistance of the covering resin strip, and a process for the preparation of this easy-open lid.

In the easy-open lid of the present invention, an organic resin coating is formed on the outer surface of the lid, the covering resin strip is formed of a plastisol of a vinyl chloride resin containing at least one additive selected from the group consisting of anchoring fillers, tackifiers and amino resins, and the covering resin strip is peelably bonded to the organic resin coating.

21 Claims, 5 Drawing Sheets

EASY-OPEN LID IN WHICH SCORE CUT EDGE CAN BE COVERED AND PROCESS FOR PREPARATION THEREOF

DESCRIPTION

1. Technical Field

The present invention relates to an easy-open can lid in which the cut edge can be covered. More particularly, the present invention relates to an easy-open can lid in which opening can be easily performed without using any particular tool and at the time of opening, a sharp cut edge is covered with a resin extending outwardly of the cut edge and the finger or the like is protected against a hurt. Especially, the present invention relates to an easy-open can lid which is excellent in the corrosion resistance of a score portion and also in the stain resistance of a covering strip of a protecting resin. Furthermore, the present invention relates to a process for the preparation of an easy-open can lid as described above.

2. Background Art

A so-called full-open can lid is known as the conventional easy-open lid for a can or a similar vessel. In this can lid, an opening score defining a portion to be opened is formed and an opening tab is arranged in this portion to be opened. At the time of opening, the score is shorn and the portion to be opened is taken out from the peripheral portion of the can lid. A sharp cut edge is present on the periphery of the removed portion and it often happens that the finger is hurt by contact with this sharp cut edge.

Various methods have been proposed for protecting the finger against a hurt by covering the sharp cut edge formed by cutting of the score with a covering resin strip formed on the can lid in advance. For example, there can be mentioned a method in which a covering resin strip is formed on the inner or outer surface of the can lid to stride over the score so that the covering resin strip is broken when the score is cut and both the cut edge of the removed portion and the cut edge of the residual peripheral portion are covered with the resin strip (see Japanese Patent Publication No. 20907/79 and Japanese Patent Publication No. 44540/82), and a method in which a covering resin strip is formed to stride over the score so that at the time of opening, the covering resin strip is not broken but is left adhering to the removed portion or the residual peripheral portion (see Japanese Patent Publication No. 18872/76 and Japanese Utility Model Application Laid-Open Specification No. 10728/85).

In the former proposal, since the covering resin strip should be broken simultaneously with cutting of the score, it is necessary that the covering resin strip should be relatively brittle or the thickness should be reduced. Furthermore, since the resin covering is present on the same plane as the cut edge of the can lid, the direct contact of the finger with the cut edge is not sufficiently prevented and the protecting effect is still insufficient.

In the latter easy-open lid having a covering resin strip, since an adhesive primer is coated on the portion where the covering resin strip of the lid is left while the primer is not coated on the portion where the covering resin strip is peeled, troublesome complicated operations are necessary, and the method is still insufficient in the productivity and manufacturing cost. Moreover, if there is not adopted any means for coating the adhesive primer on one portion while not coating the primer on the other portion, whether the covering resin strip is peeled in the state adhering to the removed portion or is left in the state adhering to the residual peripheral portion cannot be strictly controlled.

Furthermore, in the conventional easy-open lid, the opening tab is fixed by riveting, and in order to prevent damage of the score and attain precise positioning, it is generally indispensable that riveting should be accomplished by conducting bulbing, bulb reforming, buttoning, scoring and sticking in this order, and therefore, it is necessary that the protecting resin should be applied to the score after attachment of the opening tab.

Accordingly, the push-tearing top end (nose) of the opening tab should be located on the score of the opening-initiating part, and hence, the organic resin covering cannot be formed on the score portion below this push-tearing top end and it is difficult to completely cover the entire score portion. Accordingly, the cut edge is not completely covered after cutting of scoring, and rusting or pitting is caused in the uncovered score portion.

In order to increase the speed of coating of the covering resin, it is necessary to increase the rotation speed of the lid or lining gun and complete the coating operation in a short time. However, if the rotation speed of the lid or lining gun is increased the portion shaded by the opening tab is left uncoated and problems arise as regards the safety, the rust prevention of the score portion and the corrosion resistance.

If the resin is applied even to the top end of the opening tab at the organic resin-coating step or the rotation speed of the lining gun is increased, a part of the resin impinging to the tab is splashed to stick to the chuck wall portion of the lid and the post treatment, especially the lid-seaming step, is adversely influenced.

Furthermore, at the above-mentioned rotational coating step, the top end of the gun nozzle should be separated from the lid by at least a distance corresponding to the thickness of the tab, but if the rotation speed of the lid or lining gun is increased, the organic resin which is going to adhere to the lid is scattered outward by the centrifugal force and the width of the organic resin strip becomes uneven, and the commercial value is drastically reduced because of defective appearance.

SUMMARY OF THE INVENTION

It is therefore a primary object of the present invention to provide an easy-open lid provided with a covering strip of a protecting resin, in which the above-mentioned defects of the conventional easy-open lids provided with a covering strip of a protecting resin are overcome, the covering resin strip adheres closely to the lid to attain rust-preventing and corrosion-preventing effects on the score portion, the finger is effectively protected against a hurt by the cut edge of the score portion on or after the opening operation and especially, the entire covering resin strip is stuck to the portion to be removed by opening and hurting is effectively prevented by the outwardly extending covering resin strip.

Another object of the present invention is to provide an easy-open lid provided with a covering strip of a portecting resin, in which the covering resin strip has a high stain resistance and is always kept clean.

Still another object of the present invention is to provide an easy-open can lid, in which although both of a portion to be opened in the lid and a peripheral portion to be left are covered with the same outer surface coating, at the time of opening, peeling is assuredly caused between the covering resin strip on the outside of the opening score and the peripheral portion of the can lid and opening is effected in the state where the cut edge of the opened portion is covered with the covering resin strip.

A further object of the present invention is to provide an easy-open can lid which has a mechanism for assuredly fixing a covering resin strip to a portion to be opened at the opening operation.

A still further object of the present invention is to provide a process in which an easy-open can lid as described above can be prepared while overcoming the above-mentioned defects of the conventional techniques.

In accordance with one fundamental aspect of the present invention, there is provided an easy-open lid having an opening score defining a portion to be opened, an opening tab arranged on the portion to be opened and a covering strip of a protecting resin formed to stride over the opening score beyond both the sides thereof, wherein an organic resin coating is formed on the outer surface of the lid, the covering resin strip is formed of a pastisol of a vinyl chloride resin containing at least one additive selected from the group consisting of anchoring fillers, tackifiers and amino resins and the organic resin coating is peelably bonded to the covering resin strip.

In accordance with another aspect of the present invention, there is provided an easy-open lid having an opening tab defining a portion to be opened, an opening tab arranged on the portion to be opened and a covering strip of a protecting resin formed to stride over the opening score beyond both the side thereof, wherein an organic resin coating is formed on the surface of the lid in the entire portion to be scored, the organic resin coating present at least in the portion on which the covering resin strip is formed is non-adhesive to a vinyl chloride resin, the covering resin strip is formed of a plastisol of a vinyl chloride resin containing an anchoring filler and/or an amino resin and the organic resin coating is peelably bonded to the covering resin strip.

In accordance with still another object of the present invention, there is provided an easy-open can lid having an opening score formed on the can lid to define a portion to be opened, an opening tab arranged on the portion to be opened and a cut edge-covering resin strip formed between the portion to be opened and the peripheral portion of the can lid to stride over the score, wherein both the portion to be opened and the peripheral portion of the can lid have the same outer surface coating, a can lid/resin strip anchoring mechanism is disposed on the inner side of the opening score of the can lid to prevent the covering resin strip from moving outwardly in the radial direction, the covering resin strip satisfies requirements represented by the following formulae:

$$2000 \text{ g/cm} > A > 10 \text{ g/cm}, \quad (1)$$

$$T > 20 \text{ g/cm} \quad (2)$$

and $$T > \frac{2}{3}(A - C) \quad (3)$$

wherein A stands for the bonding strength per unit width (cm) between the covering resin strip and the lid, T stands for the strength per unit width (cm) of the covering resin strip, and C is a constant (900), at the time of opening, peeling is caused between the covering resin strip on the outside of the opening score and the peripheral portion of the can lid, and opening is effected in the state where the cut edge of the opened portion is covered with the covering resin strip.

In accordance with a still further aspect of the present invention, there is provided a process for the preparation of an easy-open lid, which comprises the step of forming a lid material into a lid and forming at least one score defining a portion to be opened on the lid, the step of coating a score cut edge-covering resin also acting as a score rusting-preventing covering prior to fixation of an opening tab so that the resin covers the score completely and strides over the score, and the step of bonding and fixing the opening tab to the portion to be opened so that a push-tearing top end of the opening tab is located on the covered score or in the vicinity thereof.

Figure 1:
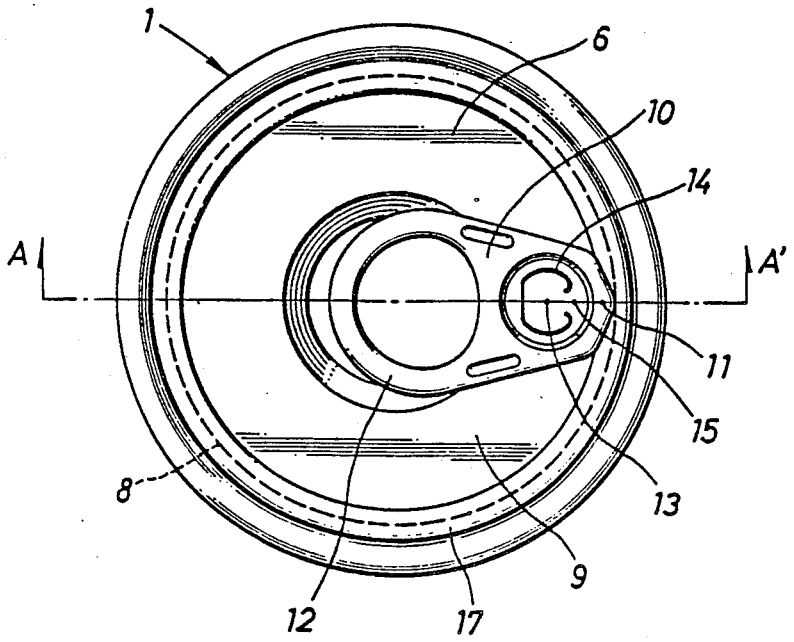
FIG. 1 is a top view of an easy-open lid according to the present invention.

Reference numerals in the drawings represent the following members.

1: lid, 2: metal blank, 3*a*: outer surface-protecting coating of lid, 3*b*: inner surface-protecting coating of lid, 4: peripheral groove, 5: annular rim, 6: panel portion, 7: sealing compound layer, 8: score, 9: portion to be opened, 10: opening tab, 11: score push-tearing top end, 12: holding portion (ring), 13: fulcrum portion, 14: U-figured cut, 15: connecting portion, 16: thermoplastic resin adhesive layer, 17: cut edge-covering resin strip, 18: peripheral portion, 19: cut edge, 20: outwardly projecting portion, 21: rim portion, 22: second score

BEST MODE FOR CARRYING OUT THE INVENTION

The present invention is based on the finding that if a resin non-adhesive toa vinyl chloride resin is used as the resin coating of a coated can lid and the covering resin strip is formed by coating and gelation of a plastisol of a vinyl chloride resin containing an anchoring filler, a tackifier or an amino resin, peelable bonding is formed between the coated can lid and the covering resin strip. Incidentally, by the term "peelable bonding", it is meant that two parts are bonded to each other but the bonding is controlled so that the two parts can be peeled from each other by the human fingers. In case of the easy-open lid of the present invention, the peelable bonding means that the bonding strength in the interface is smaller than the cohesive failure force of the covering resin strip and this bonding strength is smaller than the opening force by the fingers.

In general, in the case where the portion to be opened and the peripheral portion of the can lid are distinguished from each other as an adhesive paint-coated portion and an uncoated portion or paints differing in the bonding strength are coated on the two portions, respectively, it is possible to bond and fix the covering resin strip to the portion to be opened while maintaining the bonding between the peripheral portion of the can lid and the covering resin strip at a level of the above-mentioned peelable bonding, but in this case, since the covering resin strip and the lid are placed in the unbonded state in the portion outside the opening score of the can lid, corrosive components arrive at the score portion during retort sterilization or with the lapse of time after retort sterilization and perforation of the score portion by rusting or corrosion, that is, pitting, is caused.

From the viewpoint of the corrosion resistance of the can lid, it is deemed indispensable that a coating excellent in the corrosion resistance should be formed on the entire surface of the can lid, and in view of severe processing conditions adopted for formation of a can lid from a blank, it is indispensable that the corrosion-resistant coating should have an excellent processability. Accordingly, it is preferred that the coating to be applied to the outer surface of the can lid be the same either on the portion to be opened or on the peripheral portion of the can lid. Furthermore, in order to increase the productivity and reduce the manufacturing cost of the can lid by simplifying the process steps while avoiding complicated coating operations, it is preferred that the same coating be formed on the entire outer surface of the can lid.

According to the present invention, by using a coating non-adhesive to a vinyl chloride resin as the organic coating on the can lid and incorporating an anchoring filler, a tackifier or an amino resin into a plastisol of a vinyl chloride resin, it is possible to form peelable bonding between the covering resin strip and the organic coating on the surface of the can lid, and therefore, the portion on the inside of the opening score, that is, the opened portion, adhesion or bonding is maintained between the covering resin strip and the can lid, but on the outside of the score, peeling is readily advanced between the covering resin strip and the can lid.

At the time of opening of the easy-open can lid, the score is shorn by lifting up the portion to be opened except at the start of opening. In the covering resin strip formed to stride over the score, a tensile force acting outwardly in the radial direction is generated, and this tensile force acts as a shear stress between the covering resin strip and the coated metal sheet in the portion to be opened but as a peeling force between the covering resin strip and the coated metal sheet in the peripheral portion on the outside of the score. In the peelable bonding structure of the present invention, bonding failure is hardly caused by the shear stress but bonding failure is readily caused by the peeling force. Therefore, the covering resin strip is fixed to the opened portion and peeling is caused between the covering resin strip and the peripheral portion of the can lid on the outside of the opening score, and opening is effected in the state where the cut edge of the opened portion is covered with the covering resin strip projecting outwardly from the cut edge.

The covering strip of the present invention, which is formed of a plastisol of a vinyl chloride resin, has excellent mechanical properties and excellent barrier properties to corrosive components, which are inherent to the vinyl chloride resin, and also has good softness and cushioning properties inherent to a molded product obtained from the plastisol. Therefore, a high protecting effect against a hurt of the finger is attained, and by the adhering action of the anchoring filler, tackifier or amino resin contained in the strip, the rust-preventive effect and anti-corrosive effect to the score are improved and the action of protecting the finger against a hurt is enhanced.

In the present invention, it is preferred that peelable bonding be formed by incorporating an anchoring filler into a plastisol of a vinyl chloride resin. More specifically, if an anchoring filler such as heavy calcium carbonate, zinc oxide or magnesium oxide is incorporated into a plastisol of a vinyl chloride resin, the bonding strength between the coated can lid and the covering resin strip is about 1.3 to about 3.0 times as high as the bonding strength attained by using the anchoring filler-free plastisol, and good peelable bonding can be formed between the coated can lid and the covering resin strip.

The fact that peelable bonding can be formed by incorporation of the anchoring filler was found as a phenomenon, and the reason of this effect has not been sufficiently clarified. However, it is estimated that the above effect is probably attained through the following mechanisms. In the first place, the anchoring filler incorporated in the plastisol exerts an anchoring effect of forming anchoring points between the coated surface of the coated can lid and the covering resin strip. In the second place, although formation of a covering resin strip from the plastisol is effected through gelation of the vinyl chloride resin dispersed in a plasticizer by heating and subsequent cooling, it is believed that the thermal strain generated in the covering resin strip during such gelation and cooling drastically reduces the bonding force between the covering resin strip and the coating. The anchoring filler incorporated in the plastisol exerts the function of moderating the thermal strain generated during gelation and cooling, and also this function makes a contribution to formation of peelable bonding. In the third place, although it is known that a compound of a metal of the group II of the periodic table, such as zinc oxide or magnesium oxide, forms a polymer radical when heated, and crosslinking is caused by binding or re-binding of such polymer radicals, also in the covering vinyl chloride resin strip/coating system intended in the present invention, it is considered that an effect of improving the chemical bonding force is attained by this crosslinking.

One problem which arises when a covering resin strip is formed from a plastisol of a vinyl chloride resin is that when an easy-open lid provided with this covering resin strip is subjected in the form of a canned product to heating sterilization, the plasticizer or the like bleeds out to the surface and the surface of the covering resin strip grows sticky, with the result that dust and stain adhere to the surface and the appearance characteristics are degraded. This tendency is especially conspicuous when a tackifier is incorporated into the plastisol for increasing the bonding force of the covering resin strip to the coating. According to the present invention, by incorporating an anchoring filler into the plastisol, the sticking phenomenon can be controlled even in a heat-sterilized canned product, the stain resistance of the covering resin strip can be prominently improved and the appearance characteristics can be improved.

Moreover, if an amino acid is incorporated into the plastisol as well as the anchoring filler, the bonding force of the covering resin strip to the coating can be further improved while maintaining the stain resistance at a high level.

In the present invention, in order to cause peeling between the covering resin strip on the outside of the opening score and the peripheral portion of the can lid at the time of opening and effect opening in the state where the cut edge of the opened portion is covered with the covering resin strip, it is preferred that a can lid/covering resin strip anchoring mechanism be disposed on the inside of the opening score of the can lid to prevent the covering resin strip from moving outwardly in the radial direction.

When the easy-open can lid of the present invention is observed after opening, it is seen that substantial peeling is caused between the covering resin strip and the can lid on the outside of the above-mentioned anchoring mechanism but close adhesion is maintained between the covering resin strip and the can lid on the inside of the anchoring mechanism. Accordingly, it will be understood that the above-mentioned anchoring mechanism exerts the function of dividing the cover resin strip into the adhering zone and peeled zone and defining these zones clearly by fixing the covering resin strip to the can lid at a position different from the score portion forming a step at the time of opening.

According to the present invention, by using the covering resin strip satisfying all of the requirements represented by the above-mentioned formulae (1), (2) and (3), fixation of the covering strip to the portion to be opened and peeling of the covering strip from the peripheral portion of the can lid can be assuredly accomplished while preventing breaking of the covering resin strip.

The formula (1) has a relation to the balance between easy openability and fixation of the covering strip. If the bonding strength (A) exceeds 2000 g/cm, peeling of the covering strip becomes difficult over the entire surface, and the influence on the lid-opening force becomes too large and opening of the lid becomes difficult or opening becomes impossible in the worst case. If the bonding strength (A) is smaller than 10 g/cm, fixation of the covering strip becomes difficult, and the covering resin strip separates from the lid during handling, heat sterilization or transportation of the lid and no covering or protecting effect is attained.

The formula (2) has a relation to prevention of breaking of the covering resin strip. If the strength (T) of the covering is smaller than 20 g/cm, the covering strip is broken at the time of opening and the cut edge of the opened portion of the lid cannot be covered by the covering strip extending outwardly of the cut edge.

The formula (3) has a relation to peeling of the covering strip from the can lid and breaking of the covering strip. If the requirement of the formula (3) is not satisfied, the covering strip is not peeled from the peripheral portion of the can lid at the time of opening but is broken, and the effect of covering the cut edge is not sufficiently attained.

According to the present invention, by effecting attachment and fixation of the opening tab to the lid through bonding, rivet-forming operations (bulbing, bulb reforming, buttoning and sticking) become unnecessary, and the requirement for accuracy of positioning of the opening tab is moderated. Accordingly, the score-forming step can be separated from the opening tab-fixing step, and the coating step for forming the covering resin strip can be located between the score-forming step and the opening tab-fixing step.

Furthermore, since the organic resin is coated for forming the covering strip prior to fixation of the opening tab, it is possible to form a complete covering strip uniform in the thickness and width along the entire score.

Even in the case where the speed of the coating operation is increased by high-speed rotation of the lid or lining gun, since the tab has not been attached yet, no portion is shadowed by the tab and complete coating is possible, and splashing of the organic resin by the tab at the coating step is not caused at all. Moreover, since the tab has not been attached yet, the distance between the lining gun nozzle and the lid can be sufficiently shortened and a covering resin strip having a desired pattern and size can be obtained.

Structure of Lid

Figure 2:
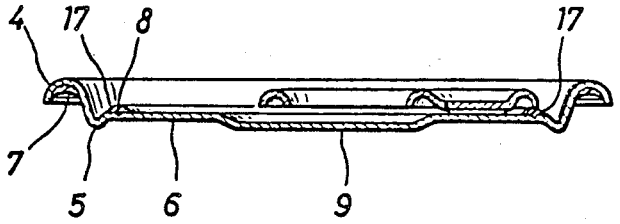
FIG. 2 is a view showing the section taken along line A—A' in the can lid shown in FIG. 1.
Figure 3A:
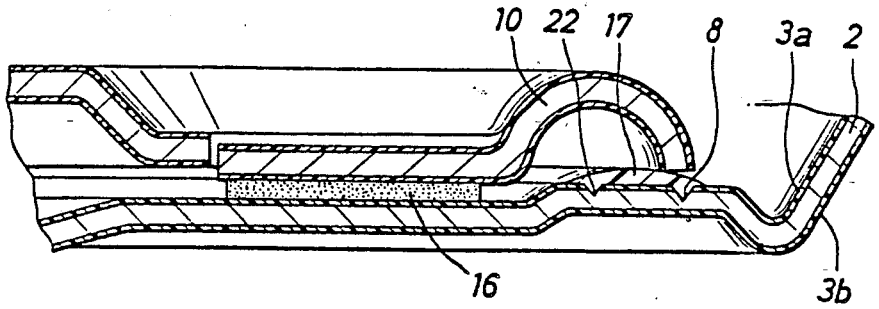
FIGS. 3-A and 3-B are sectional views showing main parts.
Figure 3B:
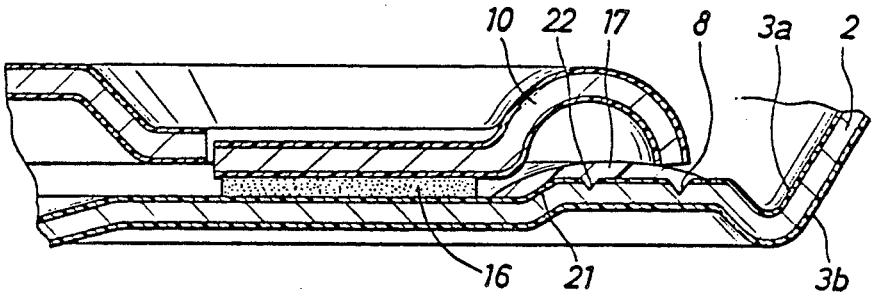

Referring to FIG. 1 illustrating the top surface of the lid of the present invention, FIG. 2 illustrating the side section of the lid and FIGS. 3-A and 3-B showing the enlarged section of the main parts, this can lid 1 has a sectional structure comprising, as shown in FIGS. 3-A and 3-B, a metal blank 2, a protecting coating 3*a* formed on the entire outer surface of the metal blank 2 and a protecting coating 3*b* formed on the entire inner surface of the metal blank 2.

The lid 1 has a panel portion 6 connected to a circumferential groove 4 on the periphery through an annular rim 5 and a sealing compound layer 7 is formed in the groove 4 so that when the lid is double-seamed with a flange (not shown) of a can barrel, the sealing compound layer 4 is sealed and engaged with the flange. A portion 9 to be opened, which is defined by a score 8, is located on the inside of the annular rim 5. The portion 9 to be opened may be substantially the same as the panel portion 6, or the portion 9 to be opened may be a part of the panel portion 6. As shown in the enlarged sectional views of FIGS. 3-A and 3-B, the score 8 is formed so that the score 8 reaches the middle of the thickness of the metal blank 2. An opening tab 10 is attached to the portion 9 to be opened in the following manner. This opening tab 10 has a score push-tearing top 11 on one end, a holding ring 12 on the other end and a fulcrum portion 13 to be bonded to the lid, which is located intermediately between both the ends. In the example shown in the drawings, the fulcrum portion 13 has a tongue-like shape which is defined by a substantially U-figured cut 14 formed so that a connecting portion 15 is present between the flucrum portion 13 and the top end 11. The push-tearing top end 11 of the opening tab 10 is fixed to the portion 9 to be opened at the tongue-like fulcrum portion 13 by heat bonding through, for example, a thermoplastic resin adhesive layer 16, so that the push-tearing top end 11 is substantially registered with the score 8.

A covering resin strip 17 for covering the cut edge, which is composed of an elastomer described in detail hereinafter, is formed on the outer surface of the can lid 1 to stride over the score 8. The covering resin strip 17 is formed along the entire length of the score 8, and as shown in FIG. 3-B, the width of the covering resin strip 17 is relatively narrow on the outside of the score 8 and relatively wide on the inside of the score 8. As is seen from the drawings, the covering resin strip 17 is filled even in the interior of the opening score 8, that is, in the groove.

Figure 4:
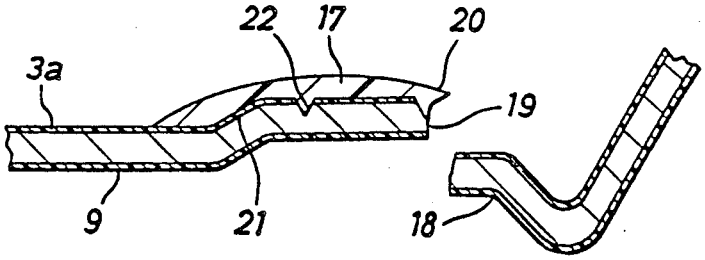
FIG. 4 is a diagram illustrating the intermediate stage of the opening operation.

In this example of the can lid, when the ring 12 is picked up by the fingers and is lifted up, this lifting force is transmitted as a downward force to the push-tearing top end 11 through the fulcrum portion 13, and the downward force is applied to the score 8 to start shearing of the score 8. Then, by further lifting up the opening tab 10, also the portion 9 to be opened is brought up and shearing of the score 8 is further advanced, and the portion 9 is taken out. Referring to FIG. 4 illustrating the intermediate stage of this opening operation, a step is formed between the portion 9 to be opened and the periphery 18 thereof while the score 8 is shorn.

In the present invention, since the covering resin strip 17 is formed of a plastisol of a vinyl chloride resin containing an anchoring filler, a tackifier or an amino resin, the covering resin strip 17 is peelably bonded through the outer surface-protecting coating 3*a*. At the time of the opening shown in FIG. 4, a tensile force is applied to the covering resin strip 17 striding over the score 8, but this tensile force acts as a shear stress at the position of the portion 9 to be opened and as a peeling force at the peripheral portion 18. In general, a bonded structure is strong to a shear stress but weak to a peeling force. Accordingly, the covering resin strip 17 is effectively fixed in the portion 9 to be opened, but in the portion 20 of the covering strip 17 that projects outwardly from the cut edge 19 of the opened portion 9, peeling from the periphery 18 is advanced, and this projecting portion 20 acts as a protector for preventing the fingers from falling in contact with the cut edge 19.

Moreover, a can lid/covering resin strip engaging mechanism formed on the inside of the opening score 8, such as a second score 22 or a rim 21, is engaged with the covering resin strip 17 to fix the covering strip 17 while preventing the covering strip 17 from being pulled and moved outwardly in the radial direction.

Covering Resin Strip

According to the present invention, the covering resin strip is formed by coating and gelation of a plastisol of a vinyl chloride resin containing an anchoring filler, a tackifier and/or an amino resin. By the plastisol is meant a paste formed by mixing a vinyl chloride resin with a plasticizer, which is gelled by heating to form a homogeneous elastomer.

In the present invention, as the vinyl chloride resin, there can be used not only a homopolymer of vinyl chloride but also a copolymer of vinyl chloride with a small amount of a comonomer such as vinyl acetate, vinylidene chloride, styrene, an acrylic acid ester, a methacrylic acid ester or butadiene. The average polymerization degree of the vinyl chloride resin is not particularly critical, but a vinyl chloride resin having an average polymerization degree of 500 to 3000 is generally preferred. Any of a vinyl chloride resin having a relatively fine particle size according to the emulsion polymerization, a vinyl chloride resin having a relatively coarse particle size according to the suspension polymerization and a blend thereof can be used for attaining the objects of the present invention.

Plasticizers customarily used for vinyl chloride resins can be used in the present invention. For example, the following plasticizers can be used.

1. Phthalic acid esters such as diethyl phthalate, di-n-butyl phthalate, di-i-butyl phthalate, dihexyl phthalate, di-i-heptyl phthalate, dioctyl phthalate (DOP) [inclusive of n-octyl, 2-ethylhexyl and iso-octyl (oxo) phthalates], di-i-heptyl-i-nonyl phthalate, di-n-octyl-n-decyl phthalate, didecyl phthalate (inclusive of n-decyl and i-decyl phthalates), dibutylbenzyl phthalate, diphenyl phthalate, dicyclohexyl phthalate, dimethylcyclohexyl phthalate, dimethoxyethyl phthalate, dibutoxyethyl phthalate, ethylphthalyl ethylglycolate and butylphthalyl butylglycolate.

2. Aliphatic dibasic acid esters such as di-i-butyl adipate, octyl adipate (inclusive of 2-ethylhexyl and n-octyl adipates), didecyl adipate (inclusive of i-decyl and n-decyl adipates), di(n-octyl-n-decyl) adipate, dibenzyl adipate, dibutyl sebacate (n-butyl sebacate), dioctyl sebacate (inclusive of 2-ethylhexyl and n-octyl sebacates), n-hexyl azelate and dioctyl azelate (2-ethylhexyl azelate).

3. Phosphoric acid esters such as diphenyl-2-ethylhexyl phosphate.

4. Hydroxypolycarboxylic acid esters such as diethyl tartrate, triethyl acetylcitrate, tributyl acetylcitrate, 2-ethylhexyl acethylcitrate, monoisoproyl citrate, tributyl citrate, monosteryl citrate, d-steryl citrate and tristeryl citrate.

5. Fatty acid esters such as methyl acetylricinoleate, ethyl palmitate, ethyl stearate, n-butyl stearate, amyl stearate, cyclohexyl stearate, butyl oleate and hydrogenated rosin methyl ester.

6. Polyhydric alcohol esters such as glycerol triacetate, glycerol propionate, tributyrate glycerol triheptanoate, glycerol monoacetylmonostearate, glycerol monoacetylmonolaurate, triethyleneglycol dicarylate, triethyleneglycol dicaprate and pentane-diol diisobutrate.

7. Epoxidized plasticizers such as epoxidized soybean oil, epoxidized castor oil, epoxidized linseed oil, epoxidized safflower oil, epoxidized butyl linseed oil fatty acid ester, octyl epoxystearate (inclusive of i-octyl and 2-ethylhexyl epoxystearates) and 3-(2-xenoxy)-1,2-epoxypropane.

8. Polyester type plasticizers such as poly(diethyleneglycol/terpene-maleic anhydride adduct) ester, poly(1,3-butane-diol/adipic acid) ester, poly(propyleneglycol/sebacic acid) ester, poly(1,3-butane-diol/sebacic acid) ester, poly(propyleneglycol/phthalic acid) ester, poly(1,3-butane-diol/phthalic acid) ester, poly(ethyleneglycol/adipic acid) ester, poly(1,6-hexane-diol/adipic acid) ester and acetylated poly(butane-diol/adipic acid) ester (inclusive of 1,3-butane-diol and 1,4-butane-diol types).

9. Other plasticizers such as alkylsulfonic acid ($C_{12}$–$C_{20}$) phenol esters, alkylsulfonic acid ($C_{12}$–$C_{20}$) cresol esters, hydrogenated polybutene, p-tert-butylphenyl salicylate and chrolinated paraffin.

The anchoring filler used in the present invention exhibits a bonding force between the covering resin strip formed from the plastisol and the coated surface on which the plastisol is applied, by the above-mentioned anchoring effect. In this sense, the anchoring filler is distinguishable from an ordinary filler.

Oxides, hydroxides and carbonates of metals of the group II of the periodic table are preferably used as the anchoring filler, though anchoring fillers that can be used are not limited to them. For example, zinc oxide, magnesium oxide, magnesium hydroxide, calcium carbonate, magnesium carbonate and basic calcium carbonate can be used, and heavy calcium carbonate, zinc oxide and magnesium oxide are especially preferred. These compounds of metals of the group II of the periodic table exert a higher effect of improving the bonding force between a covering resin and a coating than other fillers and give an excellent stain resistance to the covering resin strip. These metal compounds are also advantageous in that they are white.

The particle size of the anchoring filler used in the present invention is not particularly critical, but it is generally preferred that the particle size of the anchoring filler be 0.01 to 20 μm, particularly 0.053 to 15 μm.

In accordance with a preferred embodiment of the present invention, a combination of heavy calcium carbonate and zinc oxide is used as the anchoring filler. In this embodiment, a highest bonding force can be obtained between the covering resin strip and the coating, and the effect of improving the stain resistance is high. It is preferred that heavy calcium carbonate and zinc oxide be used at a weight ratio of from 1/0.01 to 1/10, especially from 1/0.1 to 1/5.

According to the present invention, it has been found that if an amino resin is incorporated into the plastisol together with the anchoring filler, the adhesion to the coating after retort sterilization can be highly improved while maintaining the stain resistance at a high level.

Known tackifiers such as a vinyl aromatic hydrocarbon resin, a terpene resin, a rosin resin, a coumarone-indene resin, a petroleum hydrocarbon resin and a phenolic resin can be used as the tackifier to be incorporated in the plastisol composition of the present invention.

As the vinyl aromatic hydrocarbon resin, there can be mentioned, for example, homopolymers and copolymers comprising monomers represented by the following formula and copolymers of these monomers with other ethylenically unsaturated monomers:

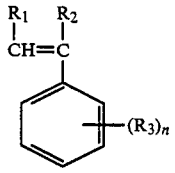

(4)

wherein $R_1$ and $R_2$ stand for a hydrogen atom or an alkyl group having up to 4 carbon atoms (hereinafter referred to as "lower alkyl group"), $R_3$ stands for an alkyl group having up to 4 carbon atoms and n is an integer of up to 2 inclusive of zero.

As preferred examples, there can be mentioned polystyrene, poly-α-methylstyrene, poly-β-methylstyrene, polyisopropenyltoluene, an α-methylstyrene/vinyltoluene copolymer, a styrene/ethyl acrylate copolymer, a styrene/ethyl acrylate/methyl methacrylate copolymer and a styrene/butadiene copolymer, though vinyl aromatic hydrocarbon resins that can be used are not limited to these polymers.

As the terpene polymer, there can be mentioned, for example, a dipentene polymer, an α-pinene polymer, a β-pinene polymer, an isoprene polymer and copolymers thereof. The terpene polymer may be modified with phenol or an organic acid.

As the rosin resin, there can be mentioned rosin and modified rosin resins such as rosin esters, ester gum, hydrogenated rosin and rosin pentaerythritol ester.

As the petroleum resin, there can be mentioned resins derived from petroleum unsaturated hydrocarbons, such as resins composed mainly of cyclopentadiene and resins composed mainly of higher olefinic hydrocarbons.

A resin having a relatively low molecular weight, which is obtained by polymerizing coumarone and indene in the presence of sulfuric acid or a Friedel-Crafts catalyst, is used as the coumarone-indene resin.

In preparing the plastisol composition used in the present invention, it is preferred that the tackifier be dissolved or dispersed in the plasticizer at a high temperature, the solution or dispersion be cooled and the vinyl chloride resin be then dispersed.

A resin obtained by condensing an amino group-containing compound such as urea, melamine, acetoguanamine or benzoguanamine with formaldehyde is used as the amino resin, and an amino resin etherified with methanol, ethanol, n-butanol or iso-butanol is preferably used. An amino resin of this type is commercially available in the form of a solution in a solvent such as methanol, butanol or xylol, and this solution is added to the plastisol and used for formation of the covering resin strip.

From the viewpoint of formation of peelable bonding, it is preferable to use an amino resin having a base concentration of 0.8 to 3.0 gram-atoms, especially 0.9 to 2.5 gram-atoms, per 100 g of the resin and a methylol group and etherified methyl group concentration of 50 to 500 millimoles, especially 60 to 400 millimoles, per 100 g of the resin.

The fact that peelable bonding becomes possible by incorporation of the amino resin in the vinyl chloride resin plastisol was found as a phenomenon. The reason why peelable bonding is attained by incorporation of the amino resin has not been sufficiently elucidated. However, it is estimated that this effect is probably attained through the following mechanism. The amino resin has in the molecule chain either a functional group such as a methylol group or etherified methylol group, or a skeleton amino group as another functional group. Formation of the covering resin strip from the plastisol is accomplished through gelation of the vinyl chloride resin dispersed in the plasticizer by heating and subsequent cooling. At the time of this heating for gelation, peelable bonding is generated by a chemical interaction between the above-mentioned functional groups in the amino resin and the coating-forming resin.

Another problem encountered when a covering resin strip is formed from a plastisol of a vinyl chloride resin is that when an easy-open can lid having this covering resin strip is subjected to heat sterilization in the form of a canned product, bleed-out of the plasticizer or the like to the surface is easily caused to render the surface of the covering strip sticky and dust and stain adhere to the surface, with the result that the appearance characteristics are degraded. This phenomenon is especially conspicuous when a tackifier is incorporated into the plastisol for increasing the bonding force of the covering resin strip to the coating. In contrast, if an amino resin is incorporated into the plastisol of the vinyl chloride resin according to the present invention, the sticking tendency is drastically controlled and the stain resistance of the covering resin strip is prominently improved, and especially high appearance characteristics can be obtained.

Moreover, if the covering resin strip is formed from the plastisol of the vinyl chloride resin having the amino resin incorporated therein, a clear (transparent) covering resin strip can be formed on the outer surface of the lid and an advantage that the commercial value of the outer surface of the canned product is not degraded can be attained.

The amino resin is advantageous over the tackifier in that the sticking phenomenon of the covering resin strip after heat sterilization is controlled and a covering resin strip excellent in the stain resistance can be formed in the peelably bonded state.

In the present invention, it is preferred that the plasticizer be used in an amount of 35 to 200 parts by weight, especially 60 to 160 parts by weight, per 100 parts by weight of the vinyl chloride resin. If the amount of the plasticizer is too small and below the above-mentioned range, a flowability necessary for coating is not obtained or a softness or cushioning property necessary for protection is not obtained. If the amount of the plasticizer is too large and exceeds the above-mentioned range, the strip-forming composition becomes too soft or the mechanical strength is excessively reduced, and the intended objects of the present invention cannot be attained.

The anchoring filler is used in an amount of 1 to 90 parts by weight, especially 5 to 70 parts by weight, per 100 parts by weight of the vinyl chloride resin so that a good flowability is maintained in the final plastisol. If the amount of the anchoring filler is too small and below the above-mentioned range, the effects of increasing the bonding strength and improving the stain resistance are insufficient, and if the amount of the anchoring filler exceeds the above-mentioned range, the covering resin strip becomes brittle.

The amount of the tackifier is changed according to the required bonding degree. In general, however, it is preferred that the tackifier be incorporated in an amount of 5 to 150 parts by weight, especially 10 to 100 parts by weight, per 100 parts by weight of the vinyl chloride resin. If the amount of the tackifier is below the above-mentioned range, it is generally difficult to improve the bonding strength over 10 g/cm, and if the amount of the tackifier exceeds the above-mentioned range, the bonding force is too high and it is difficult to perform peeling smoothly, or the sticking phenomenon becomes conspicuous in the covering strip.

It is preferred that the amino resin be incorporated in an amount of 1 to 30 parts by weight, especially 2 to 20 parts by weight, per 100 parts by weight of the vinyl chloride resin. If the amount of the amino resin is below the above-mentioned range, the hot water resistance is insufficient and it is difficult to maintain peelable bonding after retort sterilization, and if the amount of the amino resin exceeds the above-mentioned range, the plastisol becomes unstable or the viscosity is increased.

Known additives such as stabilizers, other fillers, pigments and blowing agents may be incorporated as optional components according to known recipes into the covering strip-forming vinyl chloride resin composition. For example, a metal soap stabilizer, an organotin stabilizer or an organic phosphoric acid ester stabilizer can be used as the stabilizer, and titanium white or carbon black can be used as the pigment. Moreover, azodicarbonamide or 4,4-hydroxybis(benzenesulfonyl)hydrazide can be used as the blowing agent.

Preferred recipes of the plastisol composition are described below.

| | |
|---|---|
| Opaque Recipe | |
| Vinyl chloride resin | 100 parts by weight |
| Plasticizer | 60 to 160 parts by weight |
| Blowing agent | 0 to 2 parts by weight |
| Stabilizer | 0.5 to 4 parts by weight |
| Activator | 1 to 5 parts by weight |
| Anchoring filler | 5 to 70 parts by weight |
| Pigment | 0 to 5 parts by weight |
| Clear Recipe | |
| Vinyl chloride resin | 100 parts by weight |
| Plasticizer | 60 to 160 parts by weight |
| Blowing agent | 0 to 2 parts by weight |
| Stabilizer | 0.5 to 4 parts by weight |
| Activator | 1 to 5 parts by weight |
| Transparent filler | 1 to 10 parts by weight |
| Tackifier or amino resin | 2 to 100 parts by weight |

Lid

The metal blank constituting the can lid may be a surface-treated steel sheet or an aluminum sheet, but the present invention is very advantageously applied to an easy-open can lid formed of a surface-treated steel sheet, in which a sharp cut edge is easily formed. As the surface-treated steel sheet, there can be mentioned an electrolytically chromate-treated steel sheet (TFS), a tin-plated steel sheet (tinplate), a nickel-plated steel sheet, a tin/nickel alloy-plated steel sheet and an aluminum-plated steel plate, though surface-treated steel sheets that can be used in the present invention are not limited to these steel sheets. It is preferred that the thickness of the metal blank be 0.10 to 0.40 mm, especially 0.12 to 0.35 mm.

Known protecting paints having an excellent adherence to a metal blank as described above can be optionally used for formation of the protecting coating. As the protecting paint, there can be used thermosetting and thermoplastic resin paints. For example, there can be mentioned modified epoxy paints such as a phenolepoxy paint, an amino-epoxy paint and an epoxy-ester paint, vinyl and modified vinyl paints such as a vinyl chloride/vinyl acetate copolymer, a saponified vinyl chloride/vinyl acetate copolymer, a vinyl chloride/vinyl acetate/maleic anhydride copolymer and an epoxy-modified, epoxyamino-modified or epoxyphenol-modified vinyl resin paint, acrylic resin paints, oil paints, alkyd paints, polyester paints, and synthetic rubber paints such as a styrene/butadiene copolymer.

The protecting coating may be a single coating or a laminate coating comprising an undercoat and a topcoat. Moreover, a laminate coating comprising an undercoat, a printed layer of a printing ink formed on the undercoat and a finish varnish layer formed on the printed layer may be used.

In the present invention, the organic resin coating present at least in the portion on which the covering resin strip is formed should be non-adhesive to a vinyl chloride resin. If this requirement is not satisfied, peelable bonding referred to in the present invention cannot be formed. As the outer surface paint non-adhesive to a vinyl chloride resin, there can be mentioned polyester paints such as an alkyd-amino paint, an oil-free alkyd-amino paint and a polymeric saturated polyester-amino paint, epoxy-ester paints, epoxy-amino paints, and epoxy-phenolic paints.

An epoxy paint is especially preferred as the coating formed just above the metal blank. Namely, the epoxy paint is excellent in the adhesion to a metal substrate and the processability and also in the peelable bondability to the covering resin strip, and the epoxy paint can be an excellent adhesive primer for bonding and fixing an opening tab to the can lid. A combination of an epoxy resin component and a curing agent resin component having a curing effect to the epoxy resin component, for example, a phenolformaldehyde resin or an amino resin, is preferred as the epoxy paint. A phenol-epoxy paint comprising a resol type phenol-aldehyde resin derived from a phenol and formaldehyde and a biphenol type epoxy resin is most preferred. In this paint, the phenol resin/epoxy resin weight ratio is in the range of from 90/10 to 5/95. This paint is excellent in the processability and is advantageous in that when the coated metal is subjected to the scoring operation, the corrosion resistance of the formed score is excellent. Furthermore, the paint of this type has an excellent adherence to a polyamide type adhesive used for fixation of the tab.

The thickness of the coating is not particularly critical, so far as the above-mentioned objects can be attained. Generally speaking, however, it is preferred that the thickness of the coating be 0.2 to 30 μm, especially 1 to 20 μm.

It is preferred that the opening score 8 be formed so that the residual thickness in the score is $\frac{1}{8}$ to $\frac{1}{2}$ of the blank thickness and the absolute thickness of the score be 0.2 to 0.9 mm, especially 0.3 to 0.8 mm.

For forming the covering resin strip on the lid on which the opening score has been formed, there is adopted a method in which the above-mentioned plastisol is coated and the coated plastisol is gelled. For the coating operation, there is adopted a method in which the plastisol is lined while rotating the lid or lining nozzle. It is preferred that gelation of the plastisol be carried out at a temperature of 160° to 280° C. for 10 seconds to 4 minutes. In order to perform the lining operation assuredly, it is preferred that the viscosity of the coating liquid be lower than 40000 cps.

It is preferred that the thickness of the covering resin strip be 0.005 to 0.5 mm, especially 0.01 to 0.30 mm, on the average in the direction of the width. In view of the protecting and covering effect, it is preferred that the size of the outward projection of the covering strip over the score 8 be 0.005 to 3 mm, especially 0.01 to 2 mm.

The combination of the coating and covering resin strip should satisfy the requirements represented by the above-mentioned formulae (1), (2) and (3), and it is preferred that the combination should satisfy requirements represented by the following formulae:

$$1500 \text{ g/cm} > A > 30 \text{ g/cm} \quad (1')$$

$$T > 50 \text{ g/cm} \quad (2')$$

and $$T > \frac{2}{3}(A - C) + \frac{100}{3}. \quad (3')$$

The opening tab may be composed of the same material as the can lid-constituting material or of a material different therefrom. For example, the opening tab may be formed of a sheet of a light metal such as aluminum or an aluminum alloy or a surface-treated steel sheet. An opening tab formed of a plastic material can be used if it has a sufficient rigidity.

In the case where fixation of the opening tab is performed by using a thermoplastic adhesive, a resin having amide recurring units and/or ester recurring units is preferably used. Hopolyamides, copolyamides and copolyesters having a melting point or softening point of 50° to 300° C., especially 80° to 270° C., and blends thereof are used.

In the example illustrated in the drawings, the opening tab is fixed to the can lid by bonding. Of course, fixation may be mechanically performed by riveting as in the conventional technique.

Incidentally, the second score forming the can lid-covering resin strip engagement should have such dimensions that filling of the resin and engagement between the can lid and the covering resin strip are possible. It is preferred that the width of the open portion of the score be at least 0.03 mm, especially at least 0.05 mm, particularly especially at least 0.07 mm, and the taper angle of the score be smaller than 150°, especially smaller than 135°. Moreover, it is preferred that the step size of the rim or step portion acting as the engaging mechanism be 0.10 to 1.00 mm, especially 0.15 to 0.60 mm, and that the angle to the horizontal plane be 20° to 90°, especially 30° to 85°.

Preparation of Lid

Figure 5:
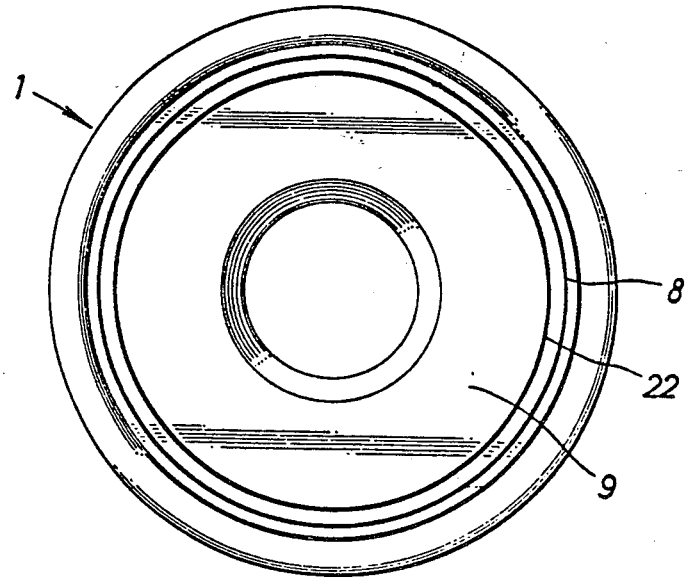
FIG. 5 is a top view showing a lid obtained at the first step of the present invention.
Figure 6:
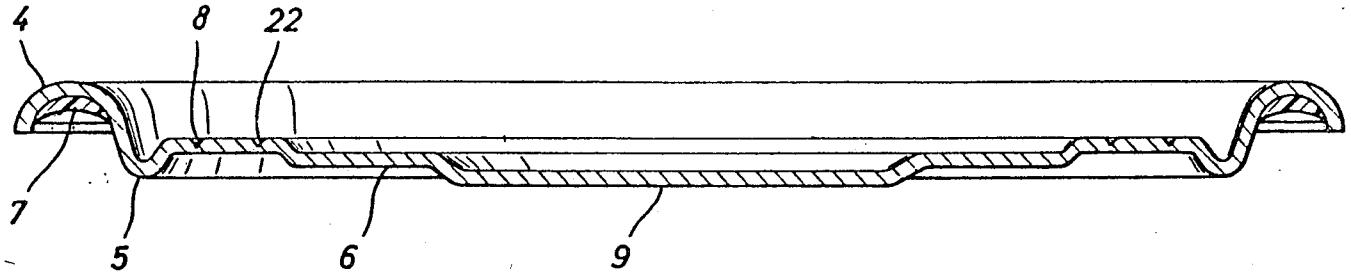
FIG. 6 is a view showing the section of the lid shown in FIG. 5.
Figure 7:
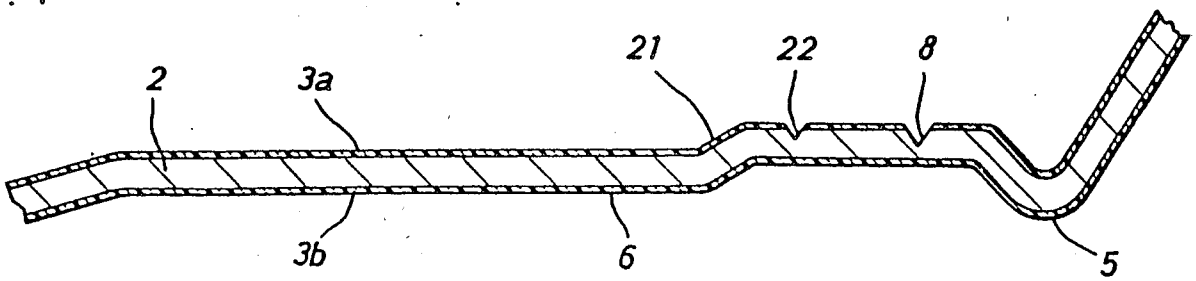
FIG. 7 is an enlarged sectional view showing main parts in FIG. 6.

Referring to FIG. 5 showing the top surface of the lid obtained at the first step, FIG. 6 showing the side section of the lid and FIG. 7 showing the enlarged section of main parts, this can lid 1 has a sectional structure comprising a metal blank 2, an outer surface-protecting coating 3a formed on the entire outer surface of the metal blank 2 and an inner surface-protecting coating 3b formed on the entire inner surface of the metal blank 2.

This lid 1 has a circumferential groove 4 on the periphery and a panel portion 6 connected to the groove through an annular rim (chuck wall portion) 5, and a sealing compound layer 7 is formed on the groove 4 so that the sealing compound layer 7 is sealed and engaged with a flange (not shown) of a can barrel when the can lid is double-seamed to the can barrel. A portion 9 to be opened, which is defined by a score 8, is present on the inside of the annular rim 5. The portion 9 to be opened may be substantially in agreement with the major part of the panel portion, or a part of the panel portion may be the portion to be opened. As shown in the enlarged sectional view of FIG. 3, the score 8 is formed so that the score reaches the middle of the thickness of the metal blank 2. The score 8 is broken at the opening operation, and in order to reduce the residual thickness of the score 8, a second score 10 may be on the inside and/or outside of the score 8.

In the embodiment illustrated in the drawings, a second score 22 is formed on the inside of the score 8 defining the portion 9 to be opened, and a rim or step portion 21 is formed on the inside of the second score 22 with a certain distance therefrom.

Formation of the lid and formation of the score, shown in FIGS. 5 through 7, can be carried out by using a known can lid-forming pressing apparatus. Furthermore, formation of the sealing compound layer 7 can be performed by applying an aqueous latex or solution of a sealing compound to the groove of the lid being rotated through a lining nozzle and drying the lid. It must be understood that this application of the sealing compound can be carried out between the first and second steps, between the second and third steps, or at an optional stage after the third step.

Figure 8:
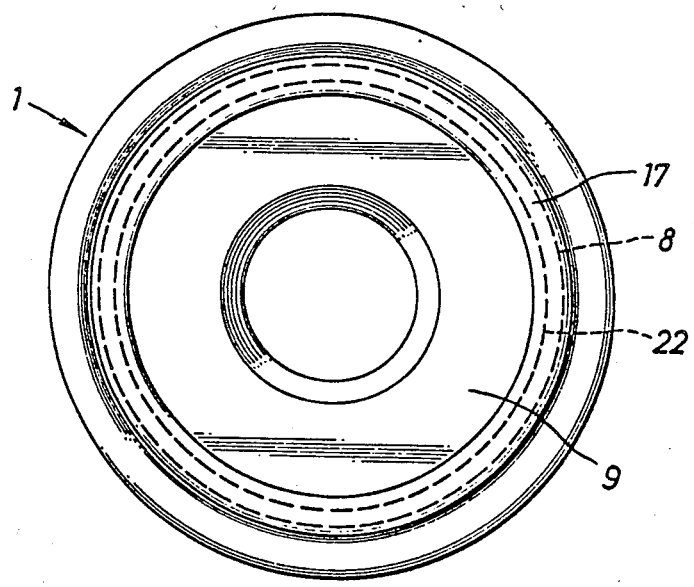
FIG. 8 is a top view showing a lid obtained at the second step of the present invention.
Figure 9:
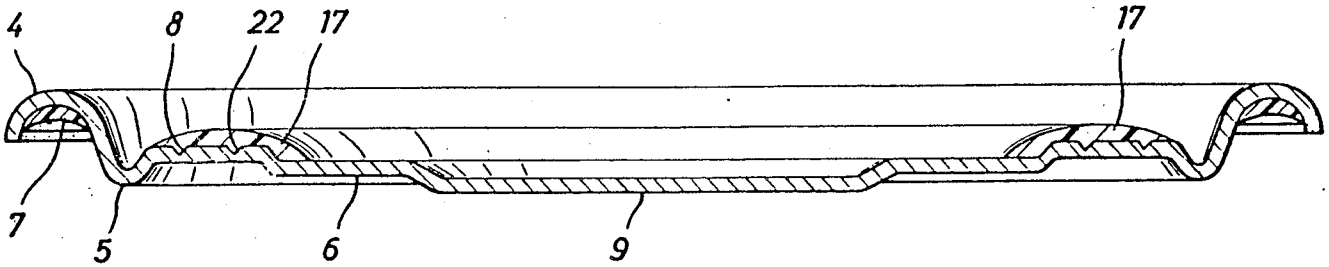
FIG. 9 is a sectional side view showing the lid shown in FIG. 8.
Figure 10:
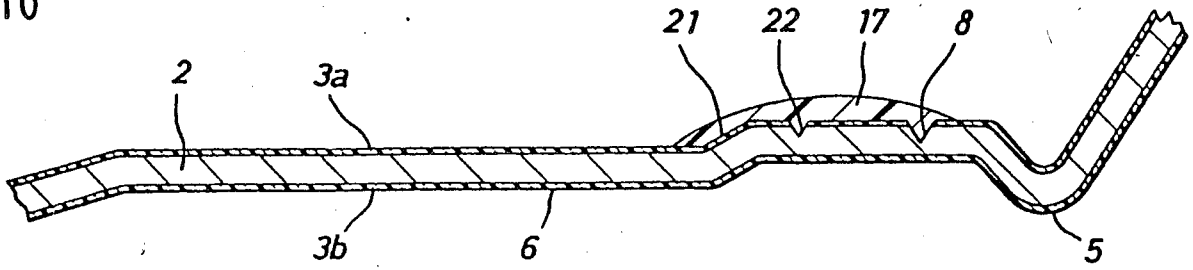
FIG. 10 is an enlarged sectional view showing main parts in FIG. 9.

Referring to FIG. 8 showing the top surface of the lid obtained at the second step, FIG. 9 showing the side section of the lid and FIG. 10 showing the section of main parts, on the outer surface side of the can lid 1, a covering resin strip 17 for covering the cut edge of the score, which is formed of an elastomer, is formed to stride over the score 17. This covering strip 17 is formed along the entire length of the score and as shown in FIG. 10, the covering strip 17 has a relatively narrow width on the outside of the score 8 and has a relatively broad width on the inside of the score 8 so that the strip 17 comletely covers the second score 22 and rim 21. Moreover, the covering resin 17 is filled even in the interior of the opening score 8 and adheres closely to both the sides of the score 8. Therefore, it is understood that the covering resin 17 also acts as a rust-preventive and anti-corrosive covering to the opening score 8. Also the second score 22 exerts a similar function.

The coating operation of forming the covering resin strip shown in FIGS. 8 through 10 is accomplished by the above-mentioned means.

Referring to FIG. 1 showing the top surface of the lid obtained at the third step and FIGS. 2, 3-A and 3-B, a push-tearing top end 11 of the opening tab 10 is heat-bonded and fixed to the portion 9 of the lid to be opened at the tongue-shaped fulcrum portion 13 through a thermoplastic resin adhesive layer 16 so that the push-tearing top end 11 is substantially registered with the score 8 of the lid.

The lid shown in FIGS. 1 and 2 is obtained by pressing the lid 1 and the fulcrum portion 13 of the opening tab 10 while the adhesive layer 16 located between them is molten and then cooling and solidifying the adhesive layer 16 under compression. At this step, heat-melting of the adhesive layer 16 is accomplished in a very short time by subjecting the corresponding portion of the lid to high-frequency induction heating, and by maintaining compression in the state where the electric power source is cut, cooling solidification of the adhesive is accomplished in a relatively short time by transfer and diffusion of heat.

(EXAMPLES)

Examples 1 through 3

An epoxy-phenolic paint was coated on both the surfaces of an ordinary tin-free steel (TFS) sheet having a thickness of 0.20 mm so that the thickness of the coating after baking was 5 μm, and baking was carried out at 210° C. for 10 minutes. The coated TFS sheet was formed into a lid having a nominal diameter of 211 by using a press, and a sealing compound was coated and dried on the curled portion according to customary procedures. Then, an opening score was formed on the outer surface side of the lid so that the ratio of the residual thickness of the score to the thickness of the steel sheet was 0.23, and a second score having a circular shape having a diameter of 54 mm, a score opening width of 0.10 mm and a score taper angle of 130° was formed on the outer surface side of the lid concentrically with the above-mentioned score.

A vinyl chloride resin plastisol of Example 1, 2 or 3 shown in Table 1 was coated on both the scores of the obtained lid by using a nozzle lining apparatus according to the rotational lining method, and the coated lid was heated at 200° C. for 2 minutes to form a covering resin strip. The thickness of the obtained covering resin strip was 0.02 mm and the length of the portion of the strip projecting outwardly of the opening score was 1 mm. Both the opening score and the second score were covered with the resin without any defect. Then, an opening tab formed from a coated TFS sheet having a thickness of 0.35 mm was bonded to the lid at 220° C. by using a filmy adhesive of nylon 12 so that the distance between the score and the bonding fulcrum was 6 mm and the width of the adhesive layer at the bonding fulcrum was 5 mm. Finally, an epoxy-phenolic paint was spray-coated on the inner surface of the lid and baking was carried out at 190° C. for 4 minutes.

The so-obtained easy-open lid was double-seamed with a flange of a can barrel having a nominal diameter of 211, and tuna dressing was packed as the content and a flat lid was seamed to the can. Then, the retort treatment was carried out at 116° C. for 90 minutes. The state of the covering resin at the time of opening the retort-treated easy-open lid and the contamination state of the covering resin strip were examined. The obtained results are shown in Table 1.

Comparative Examples 1 and 2

A lid having an opening score and a second score was prepared in the same manner as in Examples 1 through 3, and a vinyl chloride resin plastisol of Comparative Example 1 or 2 shown in Table 1 was coated on the score of the lid by using a nozzle lining apparatus according to the rotational lining method and the coated lid was heated at 200° C. for 2 minutes to form a covering resin strip having the same shape as in Examples 1 through 3.

In the same manner as in Examples 1 through 3, bonding of the tab and correction of the inner surface of the lid were carried out to prepare easy-open lids of Comparative Examples 1 and 2. Finally, as in Examples 1 through 3, these easy-open lids were double-seamed to flanges of can barrels having a nominal diameter of 211, dressing tuna was packed as the content, flat lids were seamed, and the retort treatment was carried out at 116° C. for 90 minutes. The state of the covering resin at the time of opening and the contamination state of the covering resin strip were examined with respect to each of the retort-treated easy-open lids. The obtained results are shown in Table 1.

The following can be seen from these results.

In the easy-open lids of Examples 1 through 3 according to the present invention, the epoxy-phenolic organic resin coating was formed on the outer surface side of the lid and the resin covering was formed of a specific vinyl chloride resin plastisol containing an anchoring filler. Each of these easy-open lids had on the interface a bonding strength capable of resisting the retort treatment or various handling operations and the cohesive failure force of the resin was larger than this bonding strength, and this bonding strength was smaller than the force of opening by the fingers. Moreover, in the lids of the present invention, failure of bonding (peeling) by the opening force was caused only on the outside of the opening score and bonding was maintained in other portions, and the covering strip was kept bonded to the opened portion. Namely, since the cut edge of the opened portion was covered with the covering resin strip at the time of opening, there was attained an effect of performing the opening operation without hurting the hand or fingers. Moreover, even if the covering resin strip was formed, the opening force was not influenced and opening could be performed by a small force.

Moreover, the easy-open lids were excellent in the rust-preventing property of the score portion.

TABLE 1

| | Composition of Vinyl Chloride Resin Plastisol | | | |
|---|---|---|---|---|
| | Vinyl chloride resin | Plasticizer | Anchoring filler | Other additive |
| Example 1 | emulsion-polymerized vinyl chloride homopolymer(1), 100 parts | ATBC, 50 parts ESO, 70 parts | zinc oxide, 20 parts | |
| Example 2 | emulsion-polymerized vinyl chloride homopolymer(1), 100 parts | ATBC, 50 parts ESO, 70 parts | heavy calcium carbonate, 60 parts | titanium oxide 15 parts |
| Example 3 | emulsion-polymerized vinyl chloride homopolymer(1), 100 parts | ATBC, 50 parts ESO, 70 parts | magnesium oxide, 25 parts | |
| Comparative Example 1 | emulsion-polymerized vinyl chloride homopolymer(1), 100 parts | ATBC, 50 parts ESO, 70 parts | zinc oxide 100 parts | |
| Comparative Example 2 | emulsion-polymerized vinyl chloride homopolymer(1), 100 parts | ATBC, 50 parts ESO, 70 parts | heavy calcium carbonate, | titanium oxide 15 parts |

| | Examination Results | |
|---|---|---|
| | State of covering resin strip at time of opening | Contamination state of covering resin strip |
| Example 1 | peeling was caused only on outside of opening score and covering strip was left bonded to opened portion | stainless clear covering strip was obtained |
| Example 2 | peeling was caused only on outside of opening score and covering strip was left bonded to opened portion | stainless clear covering strip was obtained |
| Example 3 | peeling was caused only on outside of opening score and covering strip was left bonded to opened portion | stainless clear covering strip was obtained |
| Comparative Example 1 | covering resin strip was brittle and covering strip was partially broken by force applied at time of opening | stainless clear covering strip was obtained |
| Comparative Example 2 | peeling of covering resin strip was already caused over entire region by retort treatment | dust and stain adhered to covering strip and appearance characteristics were degraded |

Note
(1)average polymerization degree: 1500
ATBC: tributyl acetylcitrate
ESO: epoxidized soybean oil Furthermore, in each of Examples 1 through 3, the covering resin strip was always kept stainless and clean. This is another effect attained by the present invention.

In Comparative Examples 1 and 2, the amount of the anchoring filler was outside the range specified in the present invention. In Comparative Example 1, since the amount of the anchoring filler was too large, the viscosity of the vinyl chloride resin plastisol was high and the nozzle lining operation was difficult. Furthermore, even after gelation, the covering resin strip was brittle and the covering strip was partially broken along the opening score by the force applied at the time of opening, and the cut edge of the opened portion was exposed and the risk of hurting the fingers was large. In Comparative Example 2, the amount of the anchoring filler was below the lower limit of the range specified in the present invention. Any anchoring effect was not attained by the filler, and before application of the opening force by the fingers, the covering resin strip was already peeled by the retort treatment. Furthermore, as in Comparative Example 1, the cut edge of the opened portion was exposed, and therefore, the risk of hurting the fingers was large. Moreover, dust and stain easily adhered to the covering resin strip and the appearance characteristics were drastically degraded.

Examples 4 and 5

An epoxy-phenolic paint was coated on both the surfaces of an ordinary tin-free steel (RFS) sheet having a thickness of 0.20 mm so that the coating thickness after baking was 5 μm, and baking was carried out at 210° C. for 10 minutes. Then, "indication of the opening method" was printed two times with a white ink in the area except a tab-bonded portion and an oven-print varnish (OP varnish) composed of an alkyd-amino paint was applied to the area except the tab-bonded portion, and baking was carried out at 150° C. for 10 minutes. The coated and printed sheet was formed into a lid having a nominal diameter of 211 by using a press so that the printed surface was an outer surface. Then, an opening score was formed on the outer surface of the lid so that the ratio of the residual thickness of the score to the steel sheet thickness was 0.23. A vinyl chloride resin plastisol of Example 4 or 5 shown in Table 2 was coated on the score portion of the obtained lid by using a nozzle lining apparatus according to the rotational lining method, and the coated lid was heated at 200° C. for 2 minutes to form a covering resin strip. This resin covering was formed to stride over the opening score and both the sides thereof. Then, an opening tab formed from a coated aluminum sheet having a thickness of 0.50 mm was bonded to the lid at 220° C. by using a filmy adhesive of nylon 12 so that the distance between the score and the bonding fulcrum was 6 mm and the width of the adhesive layer at the bonding fulcrum was 5 mm. Then, an epoxy-phenolic paint was spray-coated on the inner surface of the lid and baking was carried out at 190° C. for 4 minutes. A sealing compound was coated and dried on the curled portion according to customary procedures.

The so-obtained easy-open lid was double-seamed with a flange of a can barrel having a nominal diameter of 211, and tuna dressing was packed as the content. A flat lid was seamed and the retort treatment was carried out at 116° C. for 90 minutes. With respect to each of the retort-treated easy-open lids obtained in Examples 4 and 5, the state of the resin covering at the time of opening of the lid and the contamination state of the covering resin strip were examined. The obtained results are shown in Table 2.

In the easy-open lids of the present invention, the OP varnish was applied to the outer surface side of the lid and the resin covering was formed of a specific plastisol of a vinyl chloride resin containing an anchoring filler and an amino resin. Since the plastisol of the present invention contained an anchoring filler or amino resin, even if it was applied to the coated surface in a portion different from the portion in Examples 1 through 3, peelable bonding could be similarly formed. Accordingly, at the time of opening, the cut edge of the opened portion was covered with the covering resin strip, and the hand was not hurt and opening could be safely performed. Furthermore, in the obtained easy-open lid according to the present invention, the rust-preventive property of the score portion was excellent and the covering resin strip was always kept stainless and clean.

TABLE 2

| | Composition of Vinyl Chloride Resin Plastisol | | | |
|---|---|---|---|---|
| | Vinyl chloride resin | Plasticizer | Anchoring filler | Other additive |
| Example 4 | emulsion-polymerized vinyl chloride homopolymer(1), 80 parts<br>suspension-polymerized vinyl chloride homopolymer(2), 20 parts | ATBC, 60 parts<br>ESO, 60 parts | zinc oxide, 10 parts, heavy calcium carbonate, 40 parts | butylated brea resin(a), 15 titanium oxide, 15 parts |
| Example 5 | emulsion-polymerized vinyl chloride homopolymer(1), 100 parts | ATBC, 60 parts<br>ESO, 60 parts | heavy calcium carbonate, 60 parts | butylated urea resin(a), 10 parts |

| | Examination Results | |
|---|---|---|
| | State of covering resin strip at time of opening | Contamination state of covering resin strip |
| Example 4 | peeling of covering resin strip was caused only on outside of opening score and covering strip was left bonded to opened portion | stainless clean covering strip was obtained |
| Example 5 | peeling of covering resin strip was caused only on outside of opening score and covering strip was left bonded to opened portion | stainless clean covering strip was obtained |

Note
(1)average polymerization degree = 1500
(2)average polymerization degree = 1000
ATBC: tributyl acetylcitrate
ESO: epoxidized soybean oil
(a)solution (solid content of 60%) in mixed solvent of xylol and butanol

Example 6

An epoxy-phenolic paint was coated on both the surfaces of an ordinary tin-free steel (TFS) sheet having a thickness of 0.20 mm so that the coating thickness after baking was 5 μm, and baking was carried out at 210° C. for 10 minutes. The coated TFS sheet was formed into a lid having a nominal diameter of 211 by using a press and a sealing compound was coated and dried on the curled portion according to customary procedures. Then, an opening score was formed on the outer surface of the lid so that the ratio of the residual thickness of the score to the steel sheet thickness was 0.23. A plastisol of a vinyl chloride resin of Example 6 shown in Table 3 was coated on the score portion by using a nozzle lining apparatus according to the rotational lining method and was then heated to 200° C. for 2 minutes to form a covering resin strip. This resin covering was formed to stride over the opening score and both the sides thereof. An opening tab formed from a coated TFS sheet having a thickenss of 0.35 mm was bonded to the lid at 220° C. by using a filmy adhesive of nylon 12 so that the distance between the score and the bonding fulcrum was 6 mm and the width of the adhesive layer at the bonding fulcrum was 5 mm. Finally, an epoxy-phenolic paint was spray-coated on the inner surface side of the lid and baking was carried out at 190° C. for 4 minutes.

The so-obtained easy-open lid was double-seamed with a flange of a can barrel having a nominal diameter of 211, tuna dressing was packed as the content, a flat lid was seamed, and the retort treatment was carried out at 116° C. for 90 minutes. With respect to the retort-treated easy-open lid, the peeling state of the resin covering at the time of opening of the lid was examined. The obtained results are shown in Table 3.

COMPARATIVE EXAMPLES 3 AND 4

A vinyl chloride resin plastisol of Comparative Example 3 or 4 shown in Table 3 was coated on the score portion of an opening score-formed lid similar to that used in Example 6 by using a nozzle lining apparatus according to the rotational lining method, and the coated lid was heated at 200° C. for 2 minutes to form a covering resin strip. The resin covering was formed to stride over the opening score and both the sides thereof. In the same manner as in Example 6, bonding of a tab and correction of the inner surface of the lid were carried out. Thus, easy-open lids of Comparative Examples 3 and 4 were prepared. Finally, in the same manner as in Example 6, each easy-open lid was double-seamed to a flange of a can barrel having a nominal diameter of 211, tuna dressing was packed as the content, a flat lid was seamed, and the retort treatment was carried out at 116° C. for 90 minutes. With respect to each of the retort-treated easy-open lids, the peeling state of the resin covering at the time of opening of the lid was examined. The obtained results are shown in Table 3.

The following can be seen from the obtained results.

In the easy-open can lid of Example 6 according to the present invention, the epoxy-phenolic organic resin coating was formed on the outer surface side of the lid, and the resin covering was formed from a specific vinyl chloride resin plastisol containing a tackifier. In this easy-open lid, the bonding strength on the interface was enough to resist the retort treatment and various handling operations, and the cohesive failure force of the resin was larger than this bonding strength, and this bonding strength was smaller than the force of opening the lid by the fingers. In this lid of the present invention, failure of bonding (peeling) was caused only on the outside of the opening score and bonding was maintained in other region, and the covering strip was bonded to the opened portion side. Namely, since the cut edge of the opened portion was covered with the covering resin strip at the time of opening, the lid could be opened safely without hurting the hand. Moreover, in the obtained easy-open lid, the rust-preventive property of the score portion was excellent.

In Comparative Examples 3 and 4, the amount of the tackifier was outside the range specified in the present invention. In Comparative Example 3, since the amount of the tackifier was too small, even without giving an opening force, the covering resin strip was already peeled by the retort treatment. In this case, since the cut edge of the opened portion was exposed, the risk of hurting the hand was large. In Comparative Example 4, the amount of the tackifier exceeded the upper limit specified in the present invention. In this case, gelation of the plastisol was insufficient and the cohesive failure force of the covering resin strip was insufficient. Therefore, at the time of opening, the bonding strength between the covering resin strip and the lid was higher than this cohesive failure force, and the covering resin strip was not peeled but broken. Since the resin covering was on the same plane as the cut edge of the can lid, direct contact between the cut edge and the fingers was not prevented, and the protecting effect was insufficient.

TABLE 3

| | Composition of Plastisol | | | |
|---|---|---|---|---|
| | Vinyl chloride resin | Plasticizer | Tackifier | State of Covering Resin Strip |
| Example 6 | emulsion-polymerized vinyl chloride homopolymer(1), 100 parts | ATBC, 60 parts ESO, 60 parts | pentaerythritol ester of hydrogenated rosin, 70 parts | peeling of covering resin strip was caused only on outside of opening score and covering strip was left bonded to opened portion side |
| Comparative Example 3 | emulsion-polymerized vinyl chloride homopolymer(1), 100 parts | ATBC, 40 parts ESO, 20 parts | pentaerythritol ester of hydrogenated rosin, 5 parts | covering resin strip was already peeled over entire region by retort treatment |
| Comparative Example 4 | emulsion-polymerized vinyl chloride homopolymer(1) 100 parts | ATBC, 80 parts ESO, 80 parts | polymerized rosin, 110 parts | covering resin strip was not peeled on outside of opening score but broken |

Note
(1)average polymerization degree = 1500
(2)average polymerization degree = 1000
ATBC: tributyl acetylcitrate
ESO: epoxidized soybean oil Methods for evaluating the physical properties of the covering resin strip and the openability will now be described in brief before explanation of Examples 7 and 8 and Comparative Examples 5 through 7.

(Evaluation of Openability)

A sample lid was double-seamed to a flange of a can barrel having a nominal diameter of 211, and tuna dressing was packed, a flat lid was seamed and the retort treatment was carried out at 116° C. for 90 minutes. Then, the openability was evaluated.

The evaluation was carried out on the following items.

(a) Opening force (easiness of the opening operation based on that of the lid of Comparative Example 5)

(b) Safety at the time of opening (protection of the hand against a hurt)

(c) Corrosion resistance of the score portion (visual observation of rusting in the score portion).

The evaluation results were shown by marks "ʊ" (good), "X" (bad) and "Δ" (fair). (Physical Properties of Covering Resin Strip)

The physical properties before opening were evaluated with respect to the can lid of the same lot as that used for evaluation of the openability.

1. Bonding Strength

One end of the covering resin strip of a predetermined width coated and formed on the can lid or the covering resin strip backed by a reinforcing film was peeled from the coated sheet, and the 180° peel tensile test was carried out between this one end and the coated sheet. An Instron type tensile tester was used at the tensile test and the measurement was conducted at a pulling speed of 1000 mm/min at room temperature. The measurement was repeated 5 times with respect to each sample, and the arithmetic mean was converted to a value per cm of the width and the value was designated as the bonding strength (g/cm).

2. Strength

The covering resin strip coated and formed on the can lid was peeled and the test was carried out at a pulling speed of 200 mm/min at room temperature. With respect to each sample, the measurement was conducted 5 times, and the arithmetic mean was converted to a value per cm of the width and the value was designated as the strength (g/cm).

Example 7

An epoxy-phenolic paint was coated on both the surfaces of an ordinary tin-free steel (TFS) sheet having a thickness of 0.20 mm so that the coating thickness after baking was 5 μm, and baking was carried out at 210° C. for 10 minutes. The coated TFS sheet was formed into a lid having a nominal diameter of 211 by using a press, and a sealing compound was coated and dried on the curled portion according to customary procedures. An opening score having a circular shape having a diameter of 58 mm was formed on the outer surface side of the lid so that the ratio of the residual thickness of the score to the thickness of the steel sheet was 0.23, and a second score having a circular shape having a diameter of 54 mm, a score opened portion width of 1.0 mm and a score taper angle of 130° was formed on the outer surface side of the lid concentrically with the above-mentioned score. A vinyl chloride resin plastisol compound was coated on the score portion of the lid by using a nozzle lining apparatus according to the rotational lining method, and the coated lid was heated at 200° C. for 2 minutes. The thickness of the so-obtained covering resin strip was 0.02 mm, and the length of the outward projection of the resin strip over the opening score was 1 mm. Both the opening score and the second score were covered with the resin without any defect. Finally, a tab formed from a coated TFS sheet having a thickness of 0.35 mm was bonded to the lid at 220° C. by using a filmy adhesive of nylon 12 so that the distance between the score and the bonding fulcrum was 6 mm and the width of the adhesive layer at the bonding fulcrum was 5 mm. Then, an epoxy-phenolic paint was spray-coated on the inner surface side of the lid and baking was carried out at 190° C. for 4 minutes. With respect to the so-obtained easy-open can lid, the openability and the physical properties of the covering resin strip were evaluated.

The obtained results are shown in Table 4.

TABLE 4

| | Physical Properties of Covering Resin Strip | | Openability | | |
|---|---|---|---|---|---|
| | Bonding strength (g/cm) | Strength (g/cm) | Opening force | Safety | Corrosion resistance of score portion |
| Example 7 | 1000 | 400 | ○ | ○ | ○ |
| Comparative Example 5 | — | — | — | X | X |
| Comparative Example 6 | 2100 | 60 | X | — | ○ |
| Comparative Example 7 | 1300 | 100 | ○ | X | ○ |
| Comparative Example 8 | 7 | 70 | ○ | X | Δ |
| Comparative Example 9 | 700 | 10 | ○ | X | ○ |

Comparative Example 5

A lid having an opening score and a second score was prepared in the same manner as in Example 7, and a covering resin strip was not formed but an opening tab was bonded to the lid in the same manner as in Example 7 to obtain an easy-open can lid of Comparative Example 5.

Comparative Examples 6 through 9

Easy-open can lids of Comparative Examples 6 through 9 were prepared by performing coating, lid formation, scoring, covering resin strip lining, tab formation, tab bonding and inner surface correction in the same manner as in Example 7 except that the bonding strength and strength of the covering resin strip of the vinyl chloride resin plastisol were changed. With respect to each of these can lids, the openability and the physical properties of the covering resin strip were evaluated. The obtained results are shown in Table 4.

The following can be seen from these results.

Only in Example 7 where the second score was formed on the inside of the opening score of the can lid, the covering resin strip was formed to fill the second score and prevent the resin strip from moving outwardly in the radial direction and the physical properties of the covering resin strip were within specific ranges, opening could be accomplished by a small force safely without hurting the hand and even though the covering resin strip was formed, the opening force was not influenced. Furthermore, since both the scores were completely covered with the resin covering, a vessel excellent in the corrosion resistance could be provided.

In the easy-open can lid of Comparative Example 5 having no covering resin strip, since the cut edge of the opened portion was exposed at the time of opening, there was a risk of hurting finger tips. Moreover, since base iron was exposed by the scoring operation, rusting was caused in this base iron-exposed portion by the retort treatment.

In Comparative Examples 6 through 9, although the covering resin strip was formed in a predetermined preferred configuration, the physical properties of the covering resin strip were not appropriate.

In Comparative Example 6, the bonding strength exceeded 2000 g/cm, peeling of the covering strip was difficult over the entire surface, the influence of the covering strip on the lid-opening force was increased and opening became impossible in an extreme case [the requirement represented by the formula (1) in the text of the specification was not satisfied].

In Comparative Example 7, at the time of opening, the covering strip was not peeled from the peripheral portion of the can lid but was broken, and the cut edge was not sufficiently covered [the requirement represented by the formula (3) in the text of the specification was not satisfied].

In Comparative Example 8, the bonding strength was lower than 10 g/cm, fixation of the covering strip to the lid was difficult and peeling of the covering strip was caused after the retort treatment [the requirement represented by the formula (1) in the text of the specification was not satisfied].

In Comparative Example 9, the strength of the covering strip was lower than 20 g/cm, and at the time of opening, the covering strip was broken and the cut edge of the opened portion was not sufficiently covered [the requirement represented by the formula (2) in the text of the specification was not satisfied].

Consequently, it is understood that according to the present invention, by using a covering resin strip having physical properties simultaneously satisfying the requirements represented by the formulae (1) through (3), fixation of the covering strip to the portion to be opened and peeling of the covering strip from the peripheral portion of the can lid can be accomplished assuredly while preventing breaking of the covering resin strip.

Example 8

An epoxy-phenolic paint was coated on both the surfaces of an ordinary tin-free steel (TFS) sheet so that the coating thickness after baking was 5 μm, and baking was carried out at 210° C. for 10 minutes. The coated TFS sheet was formed into a lid having a nominal diameter of 211 by using a press, and a sealing compound was coated and dried on the curled portion according to customary procedures. A step having a circular shape having a diameter of 53 mm and a height of 0.35 mm was formed on the inside of the portion to be scored with the center of the lid being as the center of the circular shape so that the angle to the horizontal plane was 0°. An opening score having a circular shape having a diameter of 58 mm was formed on the outer surface of the lid concentrically with the above-mentioned step so that the ratio of the residual thickness of the score to the thickness of the steel sheet was 0.23. A vinyl chloride resin plastisol compound was coated on the score portion and step portion of the so-obtained lid by a nozzle lining apparatus according to the rotational lining method, and the coated lid was heated at 200° C. for 2 minutes. The thickness of the obtained covering resin strip was 0.03 mm, and the length of the outward projection over the opening score was 2 mm. The resin covering was uniform in the region of from the opening score to the step portion. Finally, in the same manner as described in Example 7, a coated TFS tab was bonded to the lid at 220° C. by using a filmy adhesive of nulon 12. Then, correction of the inner surface was carried out. The obtained easy-open can lid was evaluated in the same manner as in Example 7. The obtained results are shown in Table 5.

TABLE 5

| | |
|---|---|
| Bonding Strength (g/cm) | 800 |
| Strength (g/cm) | 100 |
| Opening Force | |
| Safety | |
| Corrosion Resistance of Score Portion | |

From the above results, the following can be seen.

In the present example, the step portion having a predetermined shape was formed on the inside of the opening score of the can lid, and the resin covering was formed to cover this step portion and the physical properties of the covering resin strip were within the specific ranges. In this can lid, opening could be performed safely without hurting the hand by a small opening force. Furthermore, since the score portion was completely covered with the resin covering, a vessel having an excellent corrosion resistance was obtained.

Evaluation methods will now be described in brief before explanation of Examples 9 through 12 and Comparative Examples 10 through 13.

1. State of Covering Strip of Organic Resin

1-1 Score Covering Degree

A covering resin strip was formed by coating an organic resin on the score and surrounding portion on the outer surface of a lid, and the covering state was evaluated. Point 3 was given to the lid where the score was completely covered along the entire length, point 2 was given to the lid where the ratio of the length of the covered portion of the score to the entire length of the score was 99 to 95%, and point 1 was given to the lid where the above-mentioned covering ratio was lower than 95%.

1-2 Uniformity of Covering Strip

The width of the obtained covering resin strip was measured along the entire length, and the value of (minimum width of covering strip)/(maximum width of covering strip) was calculated. Point 3 was given to the lid where the value was in the range of from 0.70 to 1, point 2 was given to the lid where the value was in the range of from 0.50 to 0.69, and point 1 was given to the lid where the value was smaller than 0.50.

2. Rusting State of Score Portion in Actual Can

2-1 Just After Heat Sterilization

A lid having a covering strip of an organic resin was seamed to a can barrel of tuna can No. 3 packed with seasoned tuna, and heat sterilization was carried out at 116° C. for 90 minutes. Just after the sterilization, the rusting state of the score on the outer surface of the lid was observed by a stereomicroscope. Point 3 was given to the lid where no rusting was observed in the score portion, point 2 was given to the lid where the ratio of the length of the portion where rusting was not observed to the entire length of the score portion was 95 to 99%, and point 1 was given to the lid where the above-mentioned ratio was lower than 95%.

2-2 After Storage

The heat-sterilized actual can obtained in 2-1 above was stored at room temperature for 1 year, and evaluation was carried out in the same manner as in 2-1 above.

3. Safety

A lid having a covering strip of an organic resin was opened, and the organic resin strip on the cut end of the opened piece was observed with the naked eye. Point 3 was given to the lid where the cut end face was completely covered with the organic resin strip, point 2 was given to the lid where the ratio of the length of the covered cut end face to the entire length of the cut end face was 95 to 99%, and point 1 was given to the lid where the above-mentioned ratio was lower than 95%.

Example 9

An epoxy-phenolic paint was coated on both the surfaces of a commercially available electrolytically chromate-treated steel sheet (0.20 mm in thickness) having a metallic chromium amount of 100 mg/m$^2$ and a chromium amount of 15 mg/m$^2$ in the non-metallic chromium layer so that the coating thickness after baking was 5 μm, and baking was carried out at 210° C. for 10 minutes. The coated chromate-treated steel sheet was formed into a lid having a nominal diameter of 211 by using a press. A sealing compound was coated and dried on the curled portion according to customary procedures. A score having a circular shape having a diameter of 58 mm was formed on the outer surface side so that the residual thickness of the score was 45 μm.

A vinyl chloride resin plastisol compound (having a viscosity of 2000 cps) was coated on the score and surrounding portion of the outer surface of the lid by using a nozzle lining apparatus at a lid rotation speed of 800 rpm while maintaining the distance between the nozzle tip and the lid at about 1 mm so that the coating thickness of the compound was 60 mg per lid, and the coated lid was heated at 150° C. for 2 minutes.

An aluminum alloy tab having both the surfaces coated with an epoxy-phenolic primer was bonded at 220° C. to the so-obtained lid by using a nylon adhesive. An epoxy-phenolic paint was spray-coated on the inner surface side of the lid so that the coating thickness after drying was 60 mg per lid, and baking was carried out at 200° C. for 4 minutes.

With respect to the so-obtained easy-open can lid, the state of the covering resin strip, the rusting state of the score portion in the actual can and the safety were evaluated. The obtained results are shown in Table 6.

Examples 10, 11 and 12

Easy-open can lids were prepared in the same manner as in Example 9 except that the coating thickness of the vinyl chloride resin plastisol compound was changed to 100 mg per lid in Example 10, 140 mg per lid in Example 11 or 200 mg per lid in Example 12. These lids were evaluated in the same manner as in Example 9. The obtained results are shown in Table 6.

Comparative Example 10

After the scoring operation was carried out in the same manner as in Example 9, an aluminum alloy tab was attached to the lid by riveting according to customary procedures.

In the same manner as described in Example 9, the vinyl chloride resin plastisol compound was coated and dried on the so-obtained lid while changing the distance between the lid and the nozzle tip to about 3 mm, and the epoxy-phenolic paint was spray-coated and dried. The lid was similarly evaluated. The obtained results are shown in Table 6.

Comparative Examples 11, 12 and 13

Lids were prepared in the same manner as in Comparative Example 10 except that the coating thickness of the vinyl chloride resin plastisol compound was changed to 100 mg per lid in Comparative Example 11, 140 mg per lid in Comparative Example 12 or 200 mg per lid in Comparative Example 13. These lids were similarly evaluated. The obtained results are shown in Table 6.

From the results obtained in Examples 9 through 12 and Comparative Examples 10 through 13, it is seen that the process in which a covering strip of an organic resin is formed on a score and a surrounding portion and a tab is then attached is advantageous over the process in which a covering strip of an organic resin is formed after attachment of a tab, in that an easy-open lid excellent in the state of the covering resin strip, the rusting-preventing effect of the score portion and the safety at the time of opening is obtained and the production can be performed at a high speed.

TABLE 6

| | Material of Covering Resin Strip | Amount Coated of Organic Resin (mg/lid) | Lid Rotation Speed at Coating of Organic Resin (RPM) | State of Covering Strip of Organic Resin: Covering degree on score | State of Covering Strip of Organic Resin: Uniformity of covering strip |
|---|---|---|---|---|---|
| Example 9 | plastisol | 60 | 800 | 3 | 3 |
| Example 10 | " | 100 | 800 | 3 | 3 |
| Example 11 | " | 140 | 800 | 3 | 3 |
| Example 12 | " | 200 | 800 | 3 | 3 |
| Comparative Example 10 | " | 60 | 800 | 1 | 1 |
| Comparative Example 11 | " | 100 | 800 | 1 | 1 |
| Comparative Example 12 | " | 140 | 800 | 1 | 1 |
| Comparative Example 13 | " | 200 | 800 | 2 | 1 |

| | Rusting of Score Portion in Actual Can: Just after heat sterilization | Rusting of Score Portion in Actual Can: After 1 year's storage | Safety | Remarks |
|---|---|---|---|---|
| Example 9 | 3 | 3 | 3 | tab was attached after coating of plastisol |
| Example 10 | 3 | 3 | 3 | tab was attached after coating of plastisol |

TABLE 6-continued

| | | | | |
|---|---|---|---|---|
| Example 11 | 3 | 3 | 3 | tab was attached after coating of plastisol |
| Example 12 | 3 | 3 | 3 | tab was attached after coating of plastisol |
| Comparative Example 10 | 1 | 1 | 1 | plastisol was coated after attachment of tab |
| Comparative Example 11 | 1 | 1 | 1 | plastisol was coated after attachment of tab |
| Comparative Example 12 | 1 | 1 | 1 | plastisol was coated after attachment of tab |
| Comparative Example 13 | 1 | 1 | 1 | plastisol was coated after attachment of tab |

What is claimed is:

1. An easy-open lid having an opening score defining a portion to be opened, an opening tab arranged on the portion to be opened and a covering strip of a protecting resin formed to stride over the opening score beyond both the sides thereof, wherein an organic resin coating is formed on the outer surface of the lid, the covering resin strip is formed of a plastisol of a vinyl chloride resin containing at least one additive selected from the group consisting of anchoring fillers, tackifiers and amino resins and the organic resin coating is peelably bonded to the covering resin strip.

2. An easy-open lid as set forth in claim 1, wherein of the organic resin coating, at least a portion on which the covering resin strip is formed is non-adhesive to a vinyl chloride resin.

3. An easy-open lid as set forth in claim 1, wherein the anchoring filler is an oxide, hydroxide or carbonate of a metal of the group II of the periodic table.

4. An easy-open lid as set forth in claim 1, wherein the anchoring filler is at least one member selected from heavy calcium carbonate, zinc oxide and magnesium oxide.

5. An easy-open lid as set forth in claim 1, wherein the plastisol is a composition comprising 100 parts by weight of a vinyl chloride resin, 35 to 200 parts by weight of a plasticizer and 1 to 90 parts by weight of an anchoring filler.

6. An easy-open lid as set forth in claim 1, wherein the plastisol is a composition comprising 100 parts by weight of a vinyl chloride resin, 35 to 200 parts by weight of a plasticizer and 5 to 150 parts by weight of a tackifier.

7. An easy-open lid as set forth in claim 1, wherein the organic resin coating is an epoxy coating.

8. An easy-open lid as set forth in claim 1, wherein the opening tab is bonded and fixed to the lid through a thermoplastic adhesive having amide recurring units and/or ester recurring units.

9. An easy-open lid as set forth in claim 1, wherein the covering strip of the protecting resin is bonded to the lid so that the covering strip is left bonded to the opened portion side at the time of opening.

10. An easy-open lid having an opening tab defining a portion to be opened, an opening tab arranged on the portion to be opened and a covering strip of a protecting resin formed to stride over the opening score beyond both the side thereof, wherein an organic resin coating is formed on the surface of the lid in the entire portion to be scored, the organic resin coating present at least in the portion on which the covering resin strip is formed is non-adhesive to a vinyl chloride resin, the covering resin strip is formed of a plastisol of a vinyl chloride resin containing an anchoring filler and/or an amino resin and the organic resin coating is peelably bonded to the covering resin strip.

11. An easy-open lid as set forth in claim 10, wherein the plastisol is a composition comprising 100 parts by weight of a vinyl chloride resin, 35 to 200 parts by weight of a plasticizer, 1 to 90 parts by weight of an anchoring filler and 1 to 30 parts by weight of an amino resin.

12. An easy-open lid as set forth in claim 10, wherein a can lid-covering resin strip engaging mechanism for preventing the covering resin strip from moving outwardly in the radial direction is formed on the inside of the opening score.

13. An easy-open lid as set forth in claim 12, wherein the can lid-covering resin strip engaging mechanism is a second score formed on the inside of the opening score and the covering resin strip is formed so that the covering resin is filled in the second score.

14. An easy-open lid as set forth in claim 12, wherein the can lid-covering resin strip engaging mechanism is a rim portion formed on the inside of the opening score and the covering resin strip is formed to cover the rip portion.

15. An easy-open lid as set forth in claim 12, wherein the covering resin strip is formed to have a relatively narrow width in the region of from the score to the peripheral portion of the can lid and a relatively broad width extending said engaging mechanism in the region of from the score to the portion to be opened.

16. An easy-open can lid having an opening score formed on the can lid to define a portion to be opened, an opening tab arranged on the portion to be opened and a cut edge-covering resin strip formed between the portion to be opened and the peripheral portion of the can lid to stride over the score, wherein both the portion to be opened and the peripheral portion of the can lid have the same outer surface coating, a can lid/resin strip anchoring mechanism is disposed on the inner side of the opening score of the can lid to prevent the covering resin strip from moving outwardly in the radial direction, the covering resin strip satisfies requirements represented by the following formulae:

$$2000\ g/cm > A > 10\ g/cm \quad (1),$$

$$T > 20\ g/cm \quad (2) \text{ and}$$

$$T > \tfrac{2}{3}(A - C) \quad (3)$$

wherein A stands for the bonding strength per unit width (cm) between the covering resin strip and the lid, T stands for the strength per unit width (cm) of the covering resin strip, and C is a constant (900), at the time of opening, peeling is caused between the covering resin strip on the outside of the opening score and the peripheral portion of the can lid, and opening is effected in the state where the cut edge of the opened portion is covered with the covering resin strip.

17. An easy-open lid having an opening score defining a portion to be opened, an opening tab arranged on the portion to be opened and a covering strip of a protecting resin formed to stride over the opening score beyond both the sides thereof, wherein an organic resin coating is formed on substantially all of the outer surface of the lid, the organic resin coating being substantially non-adhesive to a vinyl chloride resin at a portion on which the covering resin strip is formed, the covering resin strip is formed of a plastisol of a vinyl chloride containing an amino resin having a basic nitrogen atom concentration of 0.8 to 3.0 gram-atoms and having a methylol group and etherified methylol group concentration of 50 to 500 millimoles per 100 g of the resin and that the organic resin coating and the covering resin strip are peelably bonded to each other.

18. An easy-open lid having an opening score defining a portion to be opened, an opening tab arranged on the portion to be opened and a covering strip of a protecting resin formed to stride over the opening score beyond both the sides thereof, wherein an organic resin coating is formed on substantially all of the outer surface of the lid, the organic resin coating being substantially non-adhesive to a vinyl chloride resin at a portion on which the covering resin strip is formed, the covering resin strip is formed of a plastisol of a vinyl chloride containing a tackifier selected from the group consisting of a vinyl aromatic hydrocarbon resin, a terpene resin, a rosin resin, a coumarone-indene resin, a petroleum hydrocarbon resin and a phenolic resin, and that the organic resin coating and the covering resin strip are peelably bonded to each other.

19. An easy-open lid having an opening score defining a portion to be opened, an opening tab arranged on the portion to be opened and a covering strip of a protecting resin formed to stride over the opening score beyond both the sides thereof, wherein an organic resin coating is formed on the outer surface of the lid, the covering resin strip is formed of a plastisol of a vinyl chloride resin containing at least one additive selected from the group consisting of anchoring fillers, tackifiers and amino resins and the organic resin coating is peelably bonded to the covering resin strip, wherein the anchoring filler is an oxide, hydroxide or carbonate of a metal of the group II of the periodic table.

20. An easy-open lid having an opening score defining a portion to be opened, an opening tab arranged on the portion to be opened and a covering strip of a protecting resin formed to stride over the opening score beyond both the sides thereof, wherein an organic resin coating is formed on the outer surface of the lid, the covering resin strip is formed of a plastisol of a vinyl chloride resin containing at least one additive selected from the group consisting of anchoring fillers, tackifiers and amino resins and the organic resin coating is peelably bonded to the covering resin strip, wherein the anchoring filler is at least one member selected from heavy calcium carbonate, zinc oxide and magnesium oxide.

21. A process for the preparation of an easy-open lid, which comprises the steps of (a) forming a lid material into a lid and forming at least one score defining a portion to be opened on the lid;

(b) coating a score-cut edge-covering resin so that the resin covers the score completely and strides over the score, the score-cut edge-covering resin coating being formed of a plastisol of a vinyl chloride resin containing at least one additive selected from the group consisting of anchoring fillers, tackifiers and amino resins; and (c) subsequent to step (b), bonding and fixing to a portion of the lid to be opened an opening tab having a push-tearing top end, so that the push-tearing top end of the opening tab is located on the covered score or in the vicinity thereof.

* * * * *